US006083674A

United States Patent [19]

Hennessey et al.

[11] Patent Number: 6,083,674

[45] Date of Patent: Jul. 4, 2000

[54] ANTISTATIC LAYER FOR LENTICULAR SURFACE

[75] Inventors: William J. Hennessey, Rochester, N.Y.; Sharon M. Melpolder, Prescott, Ariz.; Debasis Majumdar, Rochester, N.Y.

[73] Assignee: Eastman Kodak Company, Rochester, N.Y.

[21] Appl. No.: 09/337,359

[22] Filed: Jun. 21, 1999

[51] Int. Cl.[7] ..... G03C 1/85; G03C 1/89; G03C 1/765; G03C 7/14

[52] U.S. Cl. ..... 430/496; 430/527; 430/528; 430/530; 430/946; 359/463; 359/620

[58] Field of Search ..... 430/946, 527, 430/528–530, 496; 359/463, 620

[56] References Cited

U.S. PATENT DOCUMENTS

| | | | |
|---|---|---|---|
| 3,751,258 | 8/1973 | Howe et al. | 430/946 |
| 4,070,189 | 1/1978 | Kelley et al. . | |
| 4,173,480 | 11/1979 | Woodward | 430/536 |
| 5,013,621 | 5/1991 | Kistner | 430/946 |
| 5,279,912 | 1/1994 | Telfer et al. | 430/946 |
| 5,326,688 | 7/1994 | Stimson et al. | 430/527 |
| 5,368,995 | 11/1994 | Christian et al. | 430/530 |
| 5,424,553 | 6/1995 | Morton | 250/548 |
| 5,539,487 | 7/1996 | Taguchi et al. | 354/115 |
| 5,633,719 | 5/1997 | Oehlbeck et al. | 356/401 |
| 5,639,580 | 6/1997 | Morton | 430/946 |
| 5,689,372 | 11/1997 | Morton | 430/946 |
| 5,699,190 | 12/1997 | Young et al. | 359/620 |
| 5,729,332 | 3/1998 | Fogel et al. | 355/77 |
| 5,822,038 | 10/1998 | Slater et al. | 359/463 |
| 5,869,227 | 2/1999 | Majumdat et al. | 430/527 |
| 5,891,611 | 4/1999 | Majumdat et al. | 430/527 |

FOREIGN PATENT DOCUMENTS

| | | | |
|---|---|---|---|
| 0 780 728 A1 | 6/1997 | European Pat. Off. . | |
| 4097345 | 3/1992 | Japan | 430/946 |

*Primary Examiner*—Richard L. Schilling
*Attorney, Agent, or Firm*—Paul A. Leipold

[57] ABSTRACT

The invention relates to a lenticular support comprising a polymer sheet having a lower lenticular surface, wherein said lower lenticular surface has a uniform coating of an antistat comprising clay or metal containing particles.

32 Claims, 2 Drawing Sheets

ANTISTATIC LAYER FOR LENTICULAR SURFACE

FIELD OF THE INVENTION

This invention relates to photographic lenticular imaging members and their formation.

BACKGROUND OF THE INVENTION

Fogel et al, in U.S. Pat. No. 5,729,332, describes a method and apparatus for printing lenticular images which includes imposing lines of information in the form of segmented images of a scene onto a light sensitive material.

Young et al, in U.S. Pat. No. 5,699,190, describes a lenticular media having spatially encoded portions within the media used for precisely determining the location of the lenticules within the media.

Oehlbeck et al, in U.S. Pat. No. 5,633,719, describes a lenticular print having image bundles and an apparatus for aligning and centering the image bundles under the lenticules in a composite overlay assembly process by encoding angular alignment elements into the photographic material during exposure of the element.

Slater et al, in U.S. Pat. No. 5,822,038, describes a method and apparatus for stretching, aligning and printing a plurality of images onto lenticular media having spatially encoded portions to a silver halide negative material as an alignment process prior to exposure of the negative and the lenticular media in order to correct for pitch errors between the negative and the lenticular media, but does not describe the nature, composition, nor method of preparation of the integral lenticular imaging element.

Taguchi et al, in U.S. Pat. No. 5,539,487, and a divisional patent U.S. Pat. No. 5,850,580 describes a method and apparatus for recording stereoscopic images onto an integral lenticular media using a scanning exposing device.

Howe et al, in U.S. Pat. No. 3,751,258, describes an 'auto-stereographic' print in which the integral, multilayer color photographic lenticular image also contains an integral reflective backlayer. Since the reflective backlayer is applied on the side opposite the lenticular surface as part of the preparation of the element, the element must then be exposed through the lenticular support.

Telfer et al, in U.S. Pat. No. 5,279,912, describes an integral, thermal lenticular imaging media in which the image is developed after heating via exposure with an infra-red light emitting laser.

Morton, in U.S. Pat. No. 5,689,372, describes an integral lenticular imaging element having an anti-halation layer positioned on the surface of the lenticules of the media, but does not describe the composition nor method of application of the anti-halation layer.

Morton, in European Patent Application EP 0 780 728 A1, describes an integral lenticular imaging element having an anti-halation layer positioned on the surface of the media opposed to the lenticules of the media.

Morton, in U.S. Pat. No. 5,639,580, describes an integral lenticular imaging element having a non-specular reflective backlayer positioned behind the integral image which reflects more than 80% of the light reaching the reflective layer.

Kistner, in U.S. Pat. No. 5,013,621, describes a one part coating composition for providing a white reflective backlayer to lenticular images wherein the backlayer is applied after exposure, chemical development, and drying.

Shiba in Japanese Pat. No. 4,097,345 describes a method for applying an anti-reflection overcoat to the lenticular surface of an integral color photographic element having a lenticular support.

Current color silver halide color print materials utilize three color forming layers comprised of a red light sensitive, cyan dye forming layer; a green light sensitive, magenta dye forming layer and a blue light sensitive, yellow dye forming layer. These color print or display materials -reproduce images which are 2-dimensional representations of the original 3-dimensional scene. Attempts to manufacture images in which the viewer perceives a sense of depth (or 3-dimensionality) or, images in which the viewer perceives a sense of motion have been demonstrated by several manufactures using different manufacturing processes.

Existing lenticular imaging methods and materials typically use non-integral or integral silver halide photographic elements. Other methods of lenticular imaging have also been commercialized which use various printing techniques such as lithography, ink-jet, thermal dye transfer or dye sublimation. The characteristics of these processes are such, however, that the quality of the final lenticular image is restrained by the methods and the resolution of the art which subsequently limit the number of images capable of being uniquely resolvable under each lenticule by the viewer. From the perspective of design and manufacturability, the integral silver halide elements are simpler and more attractive than their non-integral counterparts. Specifically, the integral element avoids the inherent variability associated with adhering a lenticular cover sheet to a separate silver halide element. Also, the integral element avoids the possible contamination resulting from this adhesion step.

A typical example of an integral silver halide element, per U.S. Pat. No. 3,751,258, is described in the following Table 1. This element included a permeable reflective backlayer so that after exposure, the element could be processed, with the color developers diffusing through the layer and the by-products of development washing out.

TABLE 1

| Conventional Integral Lenticular Structure[1] |
|---|
| Overcoat |
| Integral Reflective Backlayer ($TiO_2$/gelatin) |
| Gelatin Interlayer |
| Blue light sensitive layer |
| Gelatin Interlayer |
| Red light sensitive layer |
| Gelatin Interlayer |
| Green light sensitive layer |
| UV absorbing layer |
| Transparent Lenticular Support |

[1]Howe, et al, in U.S. Pat. No. 3,751,258

Like other photographic elements, the successful manufacture and use of integral silver halide elements, require effective control of static charge generation. The accumulation of charge on film or paper surfaces leads to the attraction of dirt, which can produce physical defects. The discharge of accumulated charge during or after the application of the sensitized emulsion layer(s) can produce irregular fog patterns or "static marks" in the emulsion. The static problems have been aggravated by increase in the sensitivity of new emulsions, increase in coating machine speeds, and increase in post-coating drying efficiency. The charge generated during the coating process may accumulate during winding and unwinding operations, during transport through the coating machines and during finishing operations such as slitting and spooling.

It is generally known that electrostatic charge can be dissipated effectively by incorporating one or more electrically-conductive "antistatic" layers into the film structure. Antistatic layers are typically applied as an outermost coated layer on the side of the support opposite to the emulsion.

A wide variety of electrically-conductive materials can be incorporated into antistatic layers to produce a wide range of conductivities. These can be divided into two broad groups: (i) ionic conductors and (ii) electronic conductors. In ionic conductors charge is transferred by the bulk diffusion of charged species through an electrolyte. Here the resistivity of the antistatic layer is dependent on temperature and humidity. Antistatic layers containing simple inorganic salts, alkali metal salts of surfactants, ionic conductive polymers, polymeric electrolytes containing alkali metal salts, and colloidal metal oxide sols (stabilized by metal salts), described previously in patent literature, fall in this category. However, many of the inorganic salts, polymeric electrolytes, and low molecular weight surfactants used are water-soluble and are leached out of the antistatic layers during processing, resulting in a loss of antistatic function. The conductivity of antistatic layers employing an electronic conductor depends on electronic mobility rather than ionic mobility and is independent of humidity. Antistatic layers which contain conjugated polymers, semiconductive metal halide salts, semiconductive metal oxide particles, etc., have been described previously. However, these antistatic layers typically contain a high volume percentage of electronically conducting materials which are often expensive and impart unfavorable physical characteristics, such as color, increased brittleness and poor adhesion, to the antistatic layer.

For a lenticular support, the antistatic layer additionally needs to be conformal to the lenticules so that the optical properties of the lenticules are not compromised by the overlying antistatic layer.

There remains a need in the industry for lenticular supports that may be easily manufactured, sensitized and finished without excessive generation of static electricity.

PROBLEM TO BE SOLVED BY THE INVENTION

There is a need for lenticular support materials that may be easily transported, manufactured, sensitized and finished without excessive generation of static electricity. Further there is a need for antistatic coatings for such materials that are not detrimental to photographic processing.

SUMMARY OF THE INVENTION

It is an object of the invention to provide improved lenticular imaging materials.

It is another object to provide lenticular imaging materials that may be processed through photographic developing baths without substantial detrimental effects to the baths.

These and other objects of the invention are accomplished by a lenticular support comprising a polymer sheet having a lower lenticular surface, wherein said lower lenticular surface has a uniform coating of an antistat comprising clay or metal containing particles.

ADVANTAGEOUS EFFECT OF THE INVENTION

The invention provides a lenticular imaging member that does not generate static electricity during transport when being coated with photosensitive materials. Further, the lenticular photographic members of the invention do not have deleterious effects on developing baths during development.

DETAILED DESCRIPTION OF THE INVENTION

The invention has numerous advantages over prior practices in the art. The invention provides an antistatic layer that is clear with low haze. The invention also provides an antistatic layer that has a low change in antistatic properties under differing humidity conditions. Further, the antistatic layer utilized in the invention does not wash off during processing in photographic developer materials. The antistatic layer utilized in the invention further provides a uniform layer without thickness variations that would cause image distortions or transport difficulties. These and other advantages will be apparent from the detailed description below.

Figure 1:
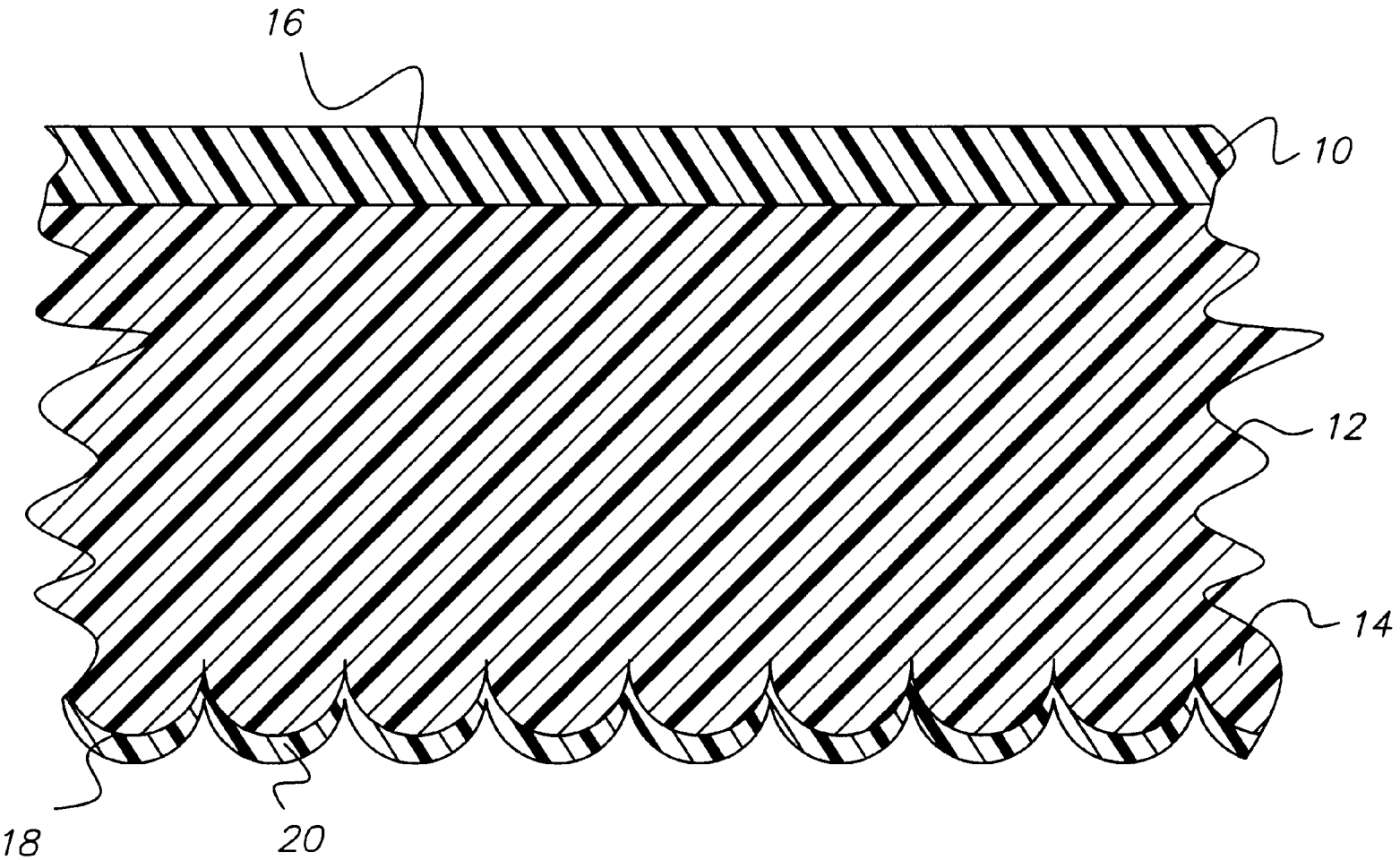
FIG. 1 is a schematic view of a cross section of a lenticular base bearing the antistatic layer utilized in the invention.

FIG. 1 is a schematic view of a cross section of a lenticular base wherein 10 is the adhesion promoting subbing layer, 12 is the polymer sheet of the lenticular support, 14 is the array of lenticules, 16 is the upper planar side of the lenticular support, 18 is the lower lenticular side of the lenticular support and 20 is the conformal antistatic layer.

Figure 2:
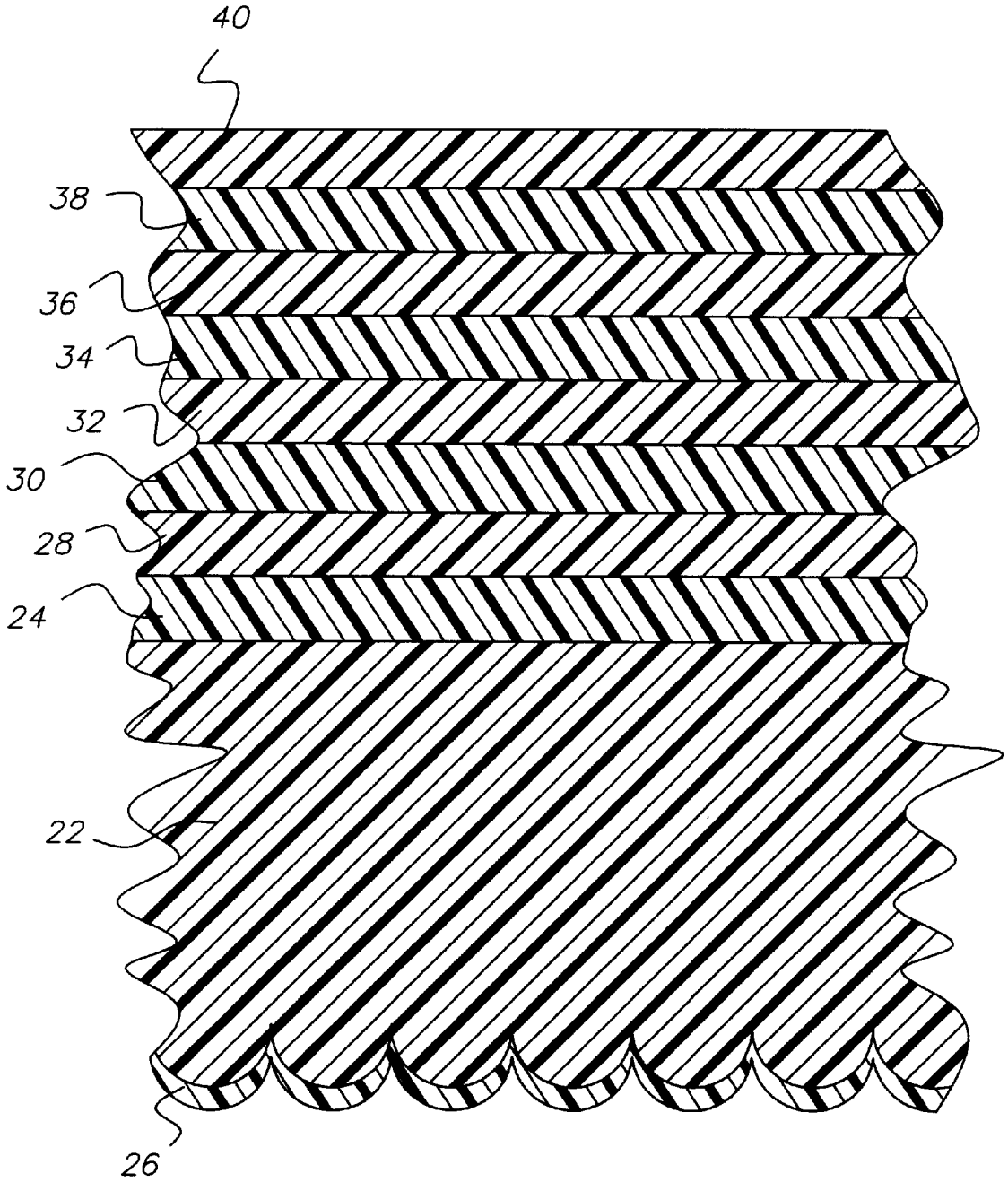
FIG. 2 is a schematic view in a cross section of a lenticular base of the invention coated with photosensitive layers.

FIG. 2 is a schematic view in a cross section of a lenticular base coated with photosensitive layers, wherein 22 is the polymer sheet of the lenticular support, 24 is the adhesion promoting subbing layer, 26 is the antistatic layer, 28 is the antihalation layer, 30 is the blue light sensitive layer, 32 is the gelatin based interlayer, 34 is the green light sensitive layer, 36 is the gelatin based interlayer, 38 is the red light sensitive layer and 40 is the overcoat.

The support utilized in the photographic element of the invention is unique in that it is not symmetrical, having an upper planar side and a lower lenticular side. The upper planar side is typically treated with a corona discharge and/or additional subbing materials such as gelatin or mixtures of polymers and gelatin in a thin layer in order to promote adhesion between the emulsion layers and the support. The lower lenticular side of the support is comprised of half-cylindrical lenses which are used to focus the image into the emulsion layers on the planar side of the support. For this reason, there is a specific relationship between the curvature of the lens, the thickness of the support and the refractive index of the support material. This relationship defines the focal length of the lens. The lenticular side of the support may also be treated with corona discharge in order to promote adhesion of additional layers of material to control static buildup during conveyance of the web through a coating machine at high speed, an anti-reflection layer to reduce light scatter while viewing the image, a protective overcoat to prevent scratching of the lenses, and other functional layers.

Suitable materials include transparent plastic materials which can be readily formed or extruded such as cellulose nitrate, cellulose acetate, cellulose acetate butyrate, polyacrylate, polystyrene, polyvinyl chloride, polyethylene terephthalate, polycarbonate, etc. A preferred material is transparent polyester sheets or webs, particularly extruded copolyesters of terephthalic acid, isophthalic acid, ethylene glycol and 1,4 cyclohexanedimethanol forming noncrystallizable polymers. Particularly preferred copolyesters include poly(1,4 cyclohexylene dimethylene terephthalate) with different amounts of glycol and 1,4 cyclohexanedimethanol. Such polyethylene terephthalate-glycolates are henceforth referred to as "PETG." The preferred material is between 75 microns and 1250 microns in thickness and most preferably about 400 microns to 750 microns in thickness.

The lenticular pitch of the material is proportional to the thickness of the support and the refractive index of the support material. Generally, the thinner the support, the higher the pitch. However, as the pitch is increased, the number of images which can be written beneath the lens element diminishes with the diameter of the cylindrical lenticular lens. For this reason, the number of lines of unique image information to be written under each lens must be known as the limitations of the systems capability to resolve each line of image information determines the ultimate pitch of the system. For the preferred thickness of support, and the characteristics of the best line writing systems and photographic characteristics, the pitch of the material is preferred to be between 5 and 60 lenticules per centimeter and more preferably between 10 and 50 per centimeter. The thickness of the lenticules can vary from 50 to 125 microns.

The antistatic layer superimposed on the lower lenticular surface of the polymer sheet of the present invention, primarily comprises an electrically conducting agent and a binder. The electrically conducting agent can be a smectite clay or a metal containing particle such as zinc antimonate. The binder in the said antistatic layer can be a hydrophilic colloid such as gelatin or a polyurethane.

The smectite clay material used in this invention is an electrically conducting smectite clay, preferably a synthetic smectite which closely resembles the natural clay mineral hectorite in both structure and composition. Hectorite is a natural swelling clay which is relatively rare and occurs contaminated with other minerals such as quartz which are difficult and expensive to remove. Synthetic smectite is free from natural impurities, prepared under controlled conditions. One such synthetic smectite is commercially marketed under the tradename Laponite by Laporte Industries, Ltd of UK through its US subsidiary, Southern Clay Products, Inc. It is a layered hydrous magnesium silicate, in which magnesium ions, partially replaced by suitable monovalent ions such as lithium, sodium, potassium and/or vacancies, are octahedrally coordinated to oxygen and/or hydroxyl ions, some of which may be replaced by fluorine ions, forming the central octahedral sheet; such an octahedral sheet is sandwiched between two tetrahedral sheets of silicon ions, tetrahedrally coordinated to oxygen. Such a synthetic smectite is preferred for incorporation in the antistatic layer of the present invention.

There are many grades of Laponite such as RD, RDS, J, S, etc. each with unique characteristics and can be used for the present invention, as long as they maintain their electrical conductivity. Some of these products contain a polyphosphate peptising agent such as tetrasodium pyrophosphate for rapid dispersion capability; alternatively, a suitable peptiser can be incorporated into Laponite later on for the same purpose. A typical chemical analysis of Laponite RDS and its physical properties, as per Laponite Product Bulletin, are provided below in Tables 1A and 1B.

TABLE 1A

Typical Chemical Analysis

| Component | Weight % |
|---|---|
| $SiO_2$ | 54.5 |
| MgO | 26.0 |
| $Li_2O$ | 0.8 |
| $Na_2O$ | 5.6 |
| $P_2O_5$ | 4.1 |
| Loss on ignition | 8.0 |

TABLE 1B

Typical Physical Properties

| | |
|---|---|
| Appearance | White Powder |
| Bulk density | 1000 kg/m$^3$ |
| Surface Area | 330 m$^2$/g |
| pH (2% suspension) | 9.7 |
| Sieve analysis, | 98% < 250$\mu$ |
| Moisture content | 10% |

Laponite separates into platelets of lateral dimension of 25–50 nm and a thickness of 1–5 nm in deionized aqueous dispersions, commonly referred to as "sols." Typical concentration of Laponite in a sol can be 0.1% through 10%. During dispersion in deionized water an electrical double layer forms around the clay platelets resulting in repulsion between them and no structure build up. However, in a formulation containing electrolytes introduced from tap water or other ingredients, the double layer can be reduced resulting in attraction between the platelets forming a "House of Cards" structure. In a dried layer, Laponite provides ionic conductivity because of the presence of charge-balancing ions in its lattice structure.

Electrically conducting metal containing particles, such as semiconductive metal oxides, when dispersed in a suitable polymeric film forming binder in an antistatic layer, can provide electronic conductivity. Binary metal oxides doped with appropriate donor heteroatoms or containing oxygen deficiencies have been disclosed in the literature to be useful in antistatic layers (vide, for example, U.S. Pat. No. 4,275,103; 4,416,963; 4,495,276; 4,418,141; 4,431,764; 4,495,276; 4,571,361; 4,999,276; 5,122,445; 5,294,525; 5,382,494 and 5,459,021). Suitable claimed conductive metal oxides include: zinc oxide, titania, tin oxide, alumina, indium oxide, silica, magnesia, zirconia, barium oxide, molybdenum trioxide, tungsten trioxide, and vanadium pentoxide. Doped conductive metal oxide granular particles include antimony-doped tin oxide, aluminum-doped zinc oxide and niobium-doped titanium oxide. For the present invention, conductive ternary metal oxides, such as zinc antimonate, as disclosed in U.S. Pat. No. 5,368,995 and incorporated in its entirety herein by reference, are preferred.

The preferred binder for the antistatic layer of the present invention is a hydrophilic colloid, such as any of the known types of gelatin, used in imaging elements. These include, for example, alkali-treated gelatin (cattle bone or hide gelatin), acid-treated gelatin (pigskin or bone gelatin), modified gelatins, gelatin derivatives such as partially phthalated gelatin, acetylated gelatin, and the like, preferably the deionized gelatins as well as gelatin grafted onto vinyl polymers.

Another preferred binder for the antistatic layer of the present invention is a water dispersible polyurethane. These polyurethanes are prepared by chain extending a prepolymer containing terminal isocyanate groups with an active hydrogen compound, usually a diamine or diol. The prepolymer is formed by reacting a diol or polyol having terminal hydroxyl groups with excess diisocyanate or polyisocyanate. To permit dispersion in water, the prepolymer is functionalized with hydrophilic groups. Anionic, cationic, or nonionically stabilized prepolymers can be prepared.

Anionic dispersions contain usually either carboxylate or sulfonate functionalized co-monomers, e.g., suitably hindered dihydroxy carboxylic acids (dimethylol propionic acid) or dihydroxy sulphonic acids. Cationic systems are prepared by the incorporation of diols containing tertiary nitrogen atoms, which are converted to the quaternary ammonium ion by the addition of a suitable alkylating agent or acid. Nonionically stabilized prepolymers can be prepared by the use of diol or diisocyanate co-monomers bearing pendant polyethylene oxide chains. These result in polyurethanes with stability over a wide range of pH. Nonionic and anionic groups may be combined synergistically to yield "universal" urethane dispersions. Of the above, anionic polyurethanes are by far the most significant.

One of several different techniques may be used to prepare polyurethane dispersions. For example, the prepolymer may be formed, neutralized or alkylated if appropriate, then chain extended in an excess of organic solvent such as acetone or tetrahydrofuran. The prepolymer solution is then diluted with water and the solvent removed by distillation. This is known as the "acetone" process. Alternatively, a low molecular weight prepolymer can be prepared, usually in the presence of a small amount of solvent to reduce viscosity, and chain extended with diamine just after the prepolymer is dispersed into water. The latter is termed the "prepolymer mixing" process and for economic reasons is much preferred over the former.

Polyols useful for the preparation of polyurethane dispersions include polyester polyols prepared from a diol (e.g. ethylene glycol, butylene glycol, neopentyl glycol, hexane diol or mixtures of any of the above) and a dicarboxylic acid or an anhydride (succinic acid, adipic acid, suberic acid, azelaic acid, sebacic acid, phthalic acid, isophthalic acid, maleic acid and anhydrides of these acids), polylactones from lactones such as caprolactone reacted with a diol, polyethers such as polypropylene glycols, and hydroxyl terminated polyacrylics prepared by addition polymerization of acrylic esters such as the aforementioned alkyl acrylate or methacrylates with ethylenically unsaturated monomers containing functional groups such as carboxyl, hydroxyl, cyano groups and/or glycidyl groups.

Diisocyanates that can be used are as follows: toluene diisocyanate, tetramethylene diisocyanate, hexamethylene diisocyanate, isophorone diisocyanate, ethylethylene diisocyanate, 2,3-dimethylethylene diisocyanate, 1-methyltrimethylene diisocyanate, 1,3-cycopentylene diisocyanate, 1,4-cyclohexylene diisocyanate, 1,3-phenylene diisocyanate, 4,4'-biphenylene diisocyanate, 1,5-naphthalene diisocyanate, bis-(4-isocyanatocyclohexyl)-methane, 4,4' diisocyanatodiphenyl ether, and tetramethyl xylene diisocyanate.

Compounds that are reactive with the isocyanate groups and have a group capable of forming an anion are as follows: dihydroxypropionic acid, dimethylolpropionic acid, dihydroxysuccinic acid and dihydroxybenzoic acid. Other suitable compounds are the polyhydroxy acids which can be prepared by oxidizing monosaccharides, for example gluconic acid, saccharic acid, mucic acid, and glucuronic acid.

Suitable tertiary amines which are used to neutralize the acid and form an anionic group for water dispersibility are trimethylamine, triethylamine, dimethylaniline, diethylaniline, and triphenylamine. Diamines suitable for chain extension of the polyurethane include ethylenediamine, diaminopropane, hexamethylene diamine, hydrazine, and amnioethylethanolamine.

Solvents which may be employed to aid in formation of the prepolymer and to lower its viscosity and enhance water dispersibility include methylethylketone, toluene, tetrahydofuran, acetone, dimethylformamide, N-methylpyrrolidone, and the like. Water-miscible solvents like N-methylpyrrolidone are much preferred.

The electrically conducting agent:binder weight ratio in the dry antistatic layer of the present invention can vary from 1:99 to 99:1 but is preferably between 10:90 and 90:10. The dry coverage of the antistatic layer is between 0.1 and 2.0 $g/m^2$.

In addition to the electrically conducting agent and the binder, the antistatic layer of the present invention may contain crosslinking agents, surfactants and coating aids, defoamers, thickeners, coalescing aids, lubricants, pH adjusting agents and other ingredients known in the art.

The following examples illustrate the practice of this invention. They are not intended to be exhaustive of all possible variations of the invention. Parts and percentages are by weight unless otherwise indicated.

Test Methods

Surface electrical resistivity (SER) is measured at different relative humidity (RH) with a Keithly Model 616 digital electrometer using a two point DC probe by a method similar to that described in U.S. Pat. No. 2,801,191. SER values <12 log ohms/square at 20% RH and <11 log ohms/square at 50% RH are considered adequate.

The antistatic coatings on the lenticular support are evaluated by a microscope for loss/delamination of the coatings after wet photographic processing, such as C-41 processing. Coatings without any loss/delamination are rated "passed" and those with loss/delamination are rated "failed".

EXAMPLES

Sample Preparation

Various antistatic layers are coated on the lower lenticular side of a PETG support which is nominally 575 microns in thickness, including 75 micron thick lenticules. The upper planar side of this PETG support is coated with an adhesion promoting subbing layer.

Working Examples

The following coating solutions A–D are used to form the various antistatic layers on the lenticular support, as per the present invention. The conductive agent used is either conductive clay or conductive ternary metal oxide zinc antimonate. The conductive clay used is Laponite RDS, supplied by Southern Clay Products. The zinc antimonate used is CELNAX CX-Z, supplied by Nissan Chemical Industries, Ltd. The binder polymer used is either deionized gelatin or a polyurethane dispersion Witcobond 232, supplied by Witco Corporation. The hardener used is either dihydroxydioxane (DHD) or a polyfunctional aziridine cross-linking agent Neocryl CX-100, supplied by Zeneca Resins. The surfactant used is Olin 10 G, a nonyl phenoxypolyglycidol, supplied by Olin Mathieson Corporation.

TABLE 2

| COATING SOLUTION A | Amount, grams |
|---|---|
| Distilled water | 668.14 |
| Deionized gelatin | 2.24 |
| Conductive clay sol, 4% | 317.63 |
| Dihydroxydioxane (DHD) hardener 0.5% | 12.00 |
| Total | 1000.00 |

TABLE 3

| COATING SOLUTION B | Amount, grams |
|---|---|
| Distilled water | 792.54 |
| Polyurethane dispersion Witco232, 30% | 24.24 |
| Conductive clay sol, 4% | 181.98 |
| CX-100 hardener 50% | 0.91 |
| Olin 10G surfactant solution 50% | 0.33 |
| Total | 1000.00 |

TABLE 4

| COATING SOLUTION C | Amount, grams |
|---|---|
| Distilled water | 944.38 |
| Deionized gelatin | 2.24 |
| Zinc antimonate dispersion 30.7% | 41.38 |
| Dihydroxydioxane (DHD) hardener 0.5% | 12 |
| Total | 1000.00 |

TABLE 5

| COATING SOLUTION D | Amount, grams |
|---|---|
| Distilled water | 951.15 |
| Polyurethane dispersion Witco232, 30% | 19.4 |
| Zinc antimonate dispersion 30.7% | 28.73 |
| CX-100 hardener 50% | 0.72 |
| Total | 1000.00 |

The following working examples, Ex. 1–12, are prepared from the coating solutions A–D in accordance with the present invention. The details about the layers and the corresponding test data are presented in Table. 6. It is clear that the antistatic layers, coated in accordance with the present invention provide adequate SER values and pass the C-41 processing without any loss/delamination. All these antistatic layers are also conformal to the lenticules without adversely affecting their optical characteristics, thus, demonstrating their suitability for application to lenticular supports.

Comparative Samples

The following coating solutions E-H are used to form the antistatic layers on the lenticular support, as comparative samples. The conductive agent used in these coating solutions is poly(N-vinylbenzyl-N,N,N-trimethylarnmonium chloride-co-ethylene glycol dimethacrylate) (93:7), as described in U.S. Pat. No. 4,070,189, and is henceforth referred to as VAEG (93:7). This is a typical conductive agent used for various photographic elements. The binder used in these coating solutions is either a cellulose ether polymer, Methocel, supplied by Dow Chemicals or polyvinyl alcohol (PVA). The hardener used is a chromium complex of methacrylic acid, Volan, supplied by Du Pont.

TABLE 7

| COATING SOLUTION E | Amount, grams |
|---|---|
| Distilled water | 921.35 |
| Cellulosic polymer Methocel | 7.15 |
| VAEG(93:7) dispersion 10% | 71.5 |
| Total | 1000.00 |

TABLE 8

| COATING SOLUTION F | Amount, grams |
|---|---|
| Distilled water | 921.35 |
| Polyvinyl alcohol | 7.15 |
| VAEG(93:7) dispersion 10% | 71.5 |
| Total | 1000.00 |

TABLE 9

| COATING SOLUTION G | Amount, grams |
|---|---|
| Distilled water | 922 |
| Cellulosic polymer Methocel | 6.5 |
| VAEG(93.7) dispersion 10% | 65 |
| Volan 20% | 6.5 |
| Total | 1000.00 |

TABLE 10

| COATING SOLUTION H | Amount, grams |
|---|---|
| Distilled water | 922 |
| Polyvinyl alcohol | 6.5 |
| VAEG(93:7) dispersion 10% | 65 |
| Volan 20% | 6.5 |
| Total | 1000.00 |

The following comparative samples Com. 1–6 are prepared from the coating solutions E–H. The details about the layers and the corresponding test data are presented in Table 9. Although electrically conducting, the control coatings of Com. 1–6 delaminated from the lenticular support during C-41 photographic processing, indicating their inferiority compared to Ex. 1–12, prepared in accordance with the present invention.

TABLE 6

| Sample | Coating solution | Conductor/binder/hardener in dry antistatic layer (wt. %) | Coverage g/m$^2$ | SER 20% RH log Ω/sq. | SER 50% RH log Ω/sq. | Post C-41 rating |
|---|---|---|---|---|---|---|
| Ex. 1 | A | Laponite/gelatin/DHD 84.7/14.9/0.4 | 0.6 | 9.4 | 8.5 | passed |
| Ex. 2 | A | Laponite/gelatin/DHD 84.7/14.9/0.4 | 0.45 | 9.5 | 8.9 | passed |
| Ex. 3 | A | Laponite/gelatin/DHD 84.7/14.9/0.4 | 0.3 | 9.8 | 8.8 | passed |
| Ex. 4 | B | Laponite/Witco232/CX100 48.5/48.5/3 | 0.6 | 10.8 | 9.8 | passed |
| Ex. 5 | B | Laponite/Witco232/CX100 48.5/48.5/3 | 0.45 | 10.8 | 9.4 | passed |
| Ex. 6 | B | Laponite/Witco232/CX100 48.5/48.5/3 | 0.3 | 11.1 | 9.9 | passed |
| Ex. 7 | C | Zinc antimonate/gelatin/DHD 84.7/14.9/0.4 | 0.6 | 7 | 7.1 | passed |
| Ex. 8 | C | Zinc antimonate/gelatin/DHD 84.7/14.9/0.4 | 0.45 | 7.3 | 7.4 | passed |
| Ex. 9 | C | Zinc antimonate/gelatin/DHD 84.7/14.9/0.4 | 0.3 | 7.6 | 7.5 | passed |
| Ex. 10 | D | Zinc antimonate/Witco232/CX100 58.8/38.8/2.4 | 0.6 | 7.9 | 7.7 | passed |
| Ex. 11 | D | Zinc antimonate/Witco232/CX100 58.8/38.8/2.4 | 0.45 | 8.1 | 8.1 | passed |
| Ex. 12 | D | Zinc antimonate/Witco232/CX100 58.8/38.8/2.4 | 0.3 | 8.6 | 10.6 | passed |

TABLE 11

| Sample | Coating solution | Conductor/binder/hardener in dry antistatic layer (wt. %) | Coverage g/m$^2$ | SER 20% RH log Ω/sq. | SER 50% RH log Ω/sq. | Post C-41 rating |
|---|---|---|---|---|---|---|
| Com. 1 Control | E | VAEG (93:7)/Methocel/Volan 50/50/0 | 0.5 | 8.6 | 7.5 | failed |
| Com. 2 Control | E | VAEG (93:7)/Methocel/Volan 50/50/0 | 0.3 | 8.7 | 7.8 | failed |
| Com. 3 Control | F | VAEG (93:7)/PVA/Volan 50/50/0 | 0.5 | 9.9 | 8.6 | failed |
| Com. 4 Control | F | VAEG (93:7)/PVA/Volan 50/50/0 | 0.3 | 10.4 | 9.1 | failed |
| Com. 5 Control | G | VAEG (93:7)/Methocel/Volan 45.45/45.45/9.1 | 0.55 | 8.6 | 7.7 | failed |
| Com. 6 Control | H | VAEG (93:7)/PVA/Volan 45.45/45.45/9.1 | 0.55 | 9.3 | 8.3 | failed |

The invention has been described in detail with particular reference to certain preferred embodiments thereof, but it will be understood that variations and modifications can be effected within the spirit and scope of the invention.

What is claimed is:

1. A lenticular support comprising a polymer sheet having a lower lenticular surface, wherein said lower lenticular surface has a uniform coating of an antistat comprising clay or metal containing particles.

2. The lenticular support of claim 1 wherein said metal containing particles comprise zinc antimonate.

3. The lenticular support of claim 1 wherein said uniform coating further comprises gelatin or polyurethane.

4. The lenticular support of claim 1 wherein said uniform coating has a thickness that does not vary by more than 25 percent from the average coverage.

5. The lenticular support of claim 1 wherein said uniform coating comprises clay and gelatin.

6. The lenticular support of claim 1 wherein said clay comprises a smectite.

7. The lenticular support of claim 1 wherein said uniform coating further comprises hardeners and surfactants.

8. The lenticular support of claim 3 wherein said polyurethane comprises a water dispersible polyurethane.

9. The lenticular support of claim 8 wherein said water dispersible polyurethane comprises an aliphatic polyurethane dispersion in water.

10. The lenticular support of claim 1 wherein said polymer sheet comprises PETG polyethylene terephthalate-glycolate.

11. The lenticular support of claim 1 wherein said polymer sheet comprises lenticules of between 50 and 125 microns and said polymer sheet thickness is between 400 and 750 microns.

12. The lenticular support of claim 1 wherein said polymer sheet comprises lenticules of a frequency of between about 10 and 50 per centimeter.

13. The lenticular support of claim 2 wherein said antistat has a dry coverage of between 0.1 and 2.0 g/m$^2$.

14. A method of forming a photographic element comprising providing a polymer sheet having lenticules on its lower surface, coating an uniform antistatic layer onto the lower surface of said polymer sheet wherein said antistatic layer comprises a water dispersion of clay or metal containing particles.

15. The method of claim 14 wherein said antistatic layer further comprises gelatin or polyurethane.

16. The method of claim 14 wherein said metal containing particles comprise zinc antimonate.

17. The method of claim 14 wherein said uniform coating has a thickness that does not vary by more than 25 percent from the average coverage.

18. The method of claim 14 wherein said uniform coating comprises clay and gelatin.

19. The method of claim 14 wherein said clay comprises a synthetic smectite.

20. The method of claim 14 wherein said uniform coating further comprises hardeners and surfactants.

21. The method of claim 15 wherein said polyurethane comprises a water dispersible polyurethane.

22. The method of claim 21 wherein said water dispersible polyurethane comprises a polyurethane dispersion in water.

23. The method of claim 14 wherein said polymer sheet comprises PETG polyethylene terephthalate-glycolate.

24. The method of claim 14 wherein said polymer sheet comprises lenticules of between 50 and 125 microns and the polymer sheet thickness is between 400 and 750 microns.

25. The method of claim 14 wherein said polymer sheet comprises lenticules of a frequency of between about 10 and 50 per centimeter.

26. The method of claim 15 wherein said antistat has a dry coverage of between 0.1 and 2.0 $g/m^2$.

27. The method of claim 14 further comprising coating at least one photosensitive silver halide layer on the upper surface of said polymer sheet.

28. The method of claim 27 wherein said at least one silver halide layer further comprises at least one dye forming coupler.

29. The method of claim 14 further comprising coating a binder layer for gelatin on the upper surface of said polymer sheet.

30. A photographic element comprising a lenticular support comprising a polymer sheet having a lower lenticular surface, wherein said lower lenticular surface has a uniform coating of an antistat comprising clay or metal containing particles.

31. The photographic element of claim 30 wherein there is at least one photosensitive silver halide containing layer on the upper surface of said polymer sheet.

32. The photographic element of claim 31 further comprising a binder layer between said polymer sheet and said at least one photosensitive silver halide containing layer.

* * * * *